US012480729B1

(12) United States Patent
Butcher

(10) Patent No.: US 12,480,729 B1
(45) Date of Patent: Nov. 25, 2025

(54) FIREARMS, SYSTEMS, AND METHODS FOR QUICK CONNECTION OF A BARREL TO A FIREARM

(71) Applicant: Matthew Butcher, Rice Lake, WI (US)

(72) Inventor: Matthew Butcher, Rice Lake, WI (US)

( * ) Notice: Subject to any disclaimer, the term of this patent is extended or adjusted under 35 U.S.C. 154(b) by 0 days.

(21) Appl. No.: 19/004,703

(22) Filed: Dec. 30, 2024

Related U.S. Application Data

(60) Provisional application No. 63/643,081, filed on May 6, 2024.

(51) Int. Cl.
*F41A 21/48* (2006.01)
*F41C 23/16* (2006.01)

(52) U.S. Cl.
CPC ..... *F41A 21/48* (2013.01); *F41C 23/16* (2013.01)

(58) Field of Classification Search
CPC ..... F41A 21/48; F41A 21/454; F41A 21/487; F41C 23/16
USPC ..... 42/75.02
See application file for complete search history.

(56) References Cited

U.S. PATENT DOCUMENTS 2,345,127 A * 3/1944 Kehne ..... F41A 21/481 42/75.02
3,540,345 A * 11/1970 Wolfe ..... F42B 39/087 89/34
5,410,834 A * 5/1995 Benton ..... F41A 21/484 42/75.02
5,540,008 A * 7/1996 Kirnstatter ..... F41A 21/484 42/75.02
6,606,812 B1 * 8/2003 Gwinn, Jr. ..... F41A 21/484 42/75.02
7,032,340 B2 * 4/2006 Baber ..... F41A 21/48 42/75.02
7,523,580 B1 * 4/2009 Tankersley ..... F41C 23/16 42/71.01
7,770,317 B1 * 8/2010 Tankersley ..... F41C 23/16 42/71.01
7,823,314 B1 * 11/2010 Wheatley ..... F41A 21/484 89/14.4
8,782,943 B2 7/2014 Jarboe
9,423,194 B2 8/2016 Fritz et al.
10,359,248 B2 * 7/2019 Zinsner ..... F41G 11/003
11,333,460 B2 * 5/2022 Wutte ..... F41A 21/481
11,841,201 B2 * 12/2023 Wutte ..... F41A 21/487
2010/0281742 A1 * 11/2010 Barrett ..... F41A 21/487 42/75.02
2014/0068987 A1 * 3/2014 Burt ..... F41A 21/48 42/71.01
2015/0007478 A1 1/2015 Barrett et al.
2015/0308779 A1 * 10/2015 McGinty ..... F41A 21/484 42/75.02
2017/0160037 A1 6/2017 Gray et al.
(Continued)

*Primary Examiner* — Troy Chambers
*Assistant Examiner* — Benjamin S Gomberg
(74) *Attorney, Agent, or Firm* — Anthony J. Bourget

(57) ABSTRACT

Firearms, components, systems and methods to quickly connect or remove a barrel to or from an upper receiver, the receiver including an elongated body defining a central bore and configured to receive a barrel of a firearm, a cam positioned within the receiver and oriented transverse the central axis where turning the cam locks a barrel into the receiver, and in aspects includes a spring which straddles the barrel and applies a force to a hand guard which in turn applies force to a rim of the barrel to lock the barrel within the upper receiver.

23 Claims, 28 Drawing Sheets

(56) References Cited

U.S. PATENT DOCUMENTS

| | | | | |
|---|---|---|---|---|
| 2020/0158460 | A1 | 5/2020 | Dextraze | |
| 2021/0278169 | A1 | 9/2021 | Zinsner et al. | |
| 2022/0178632 | A1 | 6/2022 | Lee et al. | |
| 2023/0128014 | A1* | 4/2023 | Makowski | F41A 3/88 89/1.4 |

* cited by examiner

FIREARMS, SYSTEMS, AND METHODS FOR QUICK CONNECTION OF A BARREL TO A FIREARM

CROSS-REFERENCE TO RELATED APPLICATIONS

This application claims the benefit of and priority to, U.S. Provisional Patent Application Ser. No. 63/643,081 filed on May 6, 2024 for AR *Nexus* Quick Barrel Change Rifle System, incorporated herein by reference in its entirety for continuity of disclosure.

BACKGROUND OF THE INVENTION

Various types of firearms utilize barrels that are replaceable or interchangeable. A user may wish to replace a barrel of a rifle, for instance, to enable a change of caliber of ammunition used with the firearm, or to provide replacement of damaged barrels, or to use barrels of different lengths for different tactics, or for other reasons. Various rifles and mechanisms have been developed to attach/detach a barrel from the firearm, and for which patents have been filed or granted, such as those in U.S. Pat. Nos. 8,782,943, 9,423,194, and U.S. Patent Application Publications US2017/0160037, US 2020/0158460, US 2021/0278169, US 2022/0178632, US 2015/0308779, and 2015/0007478, among perhaps others. While such rifles and mechanisms may have benefits, there is room for improvement.

SUMMARY OF THE INVENTION

The invention allows for easy exchange of barrels of a firearm. The invention includes firearms or firearm components having mechanisms to connect a variety of different barrels or barrel systems to the firearm or components. An AR-15 style of firearm is one example and includes a barrel inserted into an upper receiver having a spring cavity, a hand guard configured to pass along the barrel and configured to mate with the upper receiver, and a spring configured to fit into the spring cavity to abut the hand guard to secure the barrel to the upper receiver. In aspects the barrel includes a rim where an end of the hand guard abuts the rim. In further aspects the firearm or component receives a pin having a non-circular cross section which is rotated to abut tines of the spring which straddle the barrel and secure the barrel to the upper receiver. A variety of types of barrels may be used with the AR-15 style of firearm 20, and it may be appreciated that different firearms, other than AR-15 varieties, may also be configured to receive different barrels or barrel assemblies in accordance with aspects of the invention. Firearms other than AR-15 style may also utilize the features of the invention.

In further aspects the invention includes a system for quick connection of a barrel to a firearm where a receiver is configured to receive the barrel and a spring positioned within the receiver is configured to straddle the barrel where a cam is configured to abut the spring and secure the barrel within the receiver when the cam is turned. In aspects the system may also include a hand guard positioned over the barrel and abutting a rim of the barrel within the receiver where rotation of the cam causes the spring to force against the hand guard which in turn presses against the rim to secure the barrel within the receiver.

In a further aspect the system includes a firearm component having an upper receiver defining a bore passing from a stock end through to a barrel end, the bore defining a central axis, the upper receiver configured to receive a barrel of a firearm and a cam oriented transvers the central axis where activation of the cam locks into the upper receive a barrel which may be inserted therein. In aspects the component includes a pin having a non-circular cross-sectioned portion where rotation of the pin locks into the upper receiver the barrel which may be inserted therein.

In further aspects the invention includes a method of assembling a firearm having a receiver, including inserting a barrel into the receiver, the barrel having a rim and a bore defining a central axis through the barrel, and rotating, within the receiver, a pin having a non-circular cross-section, the pin oriented transverse the central axis such that rotation of the pin locks the rim and barrel into the receiver. In aspects the method includes positioning a hand guard over the barrel and into the receiver where rotation of the pin applies force to the hand guard which in turn applies force to the rim to lock the barrel into the receiver. In aspects the method includes insertion of a spring into the receiver where the spring straddles the barrel and rotation of the pin applies force to the spring which in turn applies force directly to the rim or to the handguard and then to the rim to lock the barrel.

The above partial summary is not intended to describe each illustrated embodiment, aspect, or every implementation of the present invention. The figures and detailed description and claims that follow more particularly exemplify these and other embodiments and further aspects of the invention.

Figure 1:
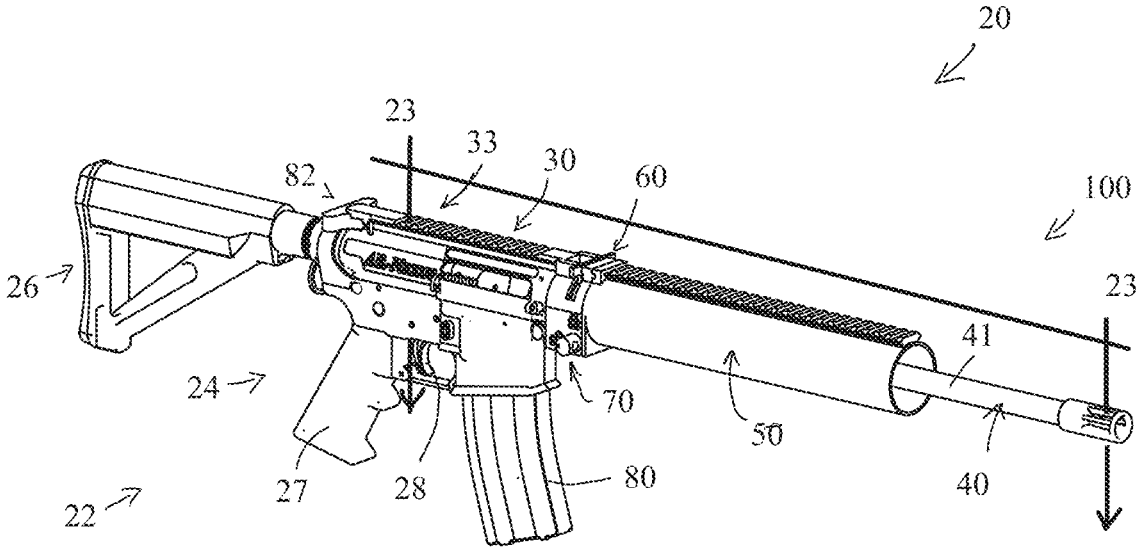
FIG. 1 is a perspective view of a firearm, firearm components, system and methods in accordance with aspects of the invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Figure 2:
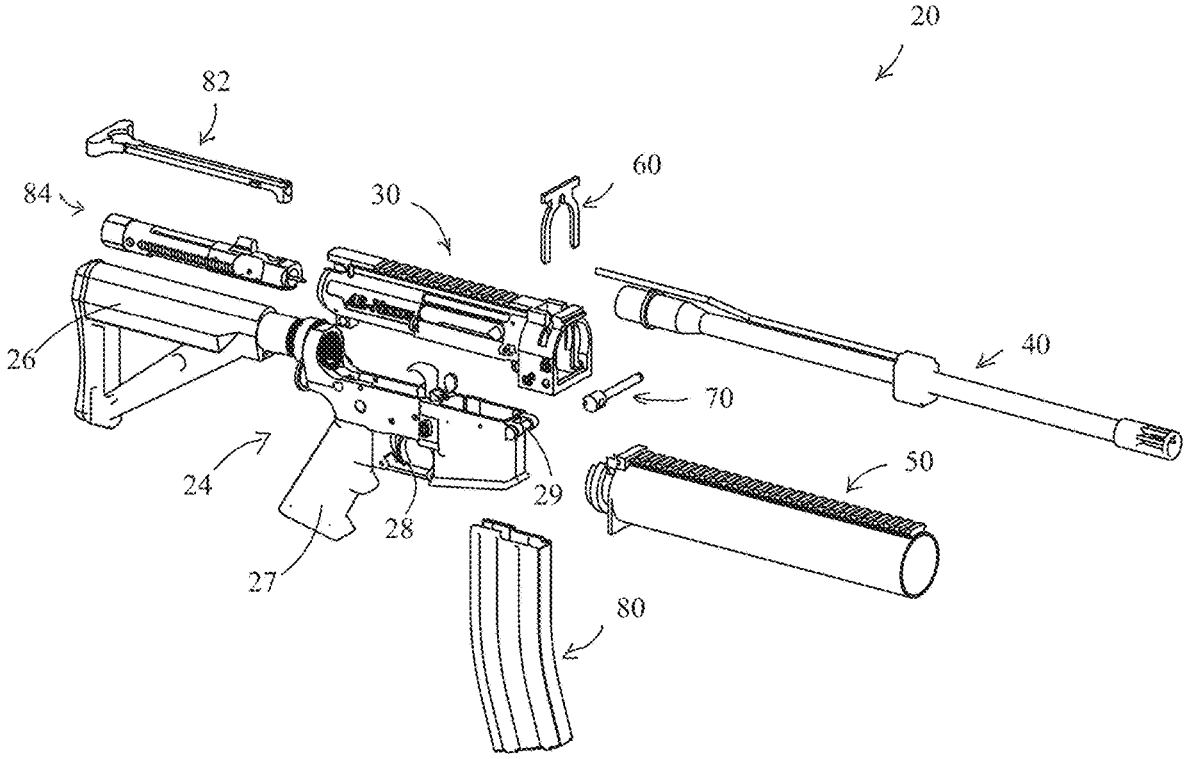
FIG. 2 is an exploded perspective view of the firearm and representative components, system and methods of FIG. 1.
Figure 3:
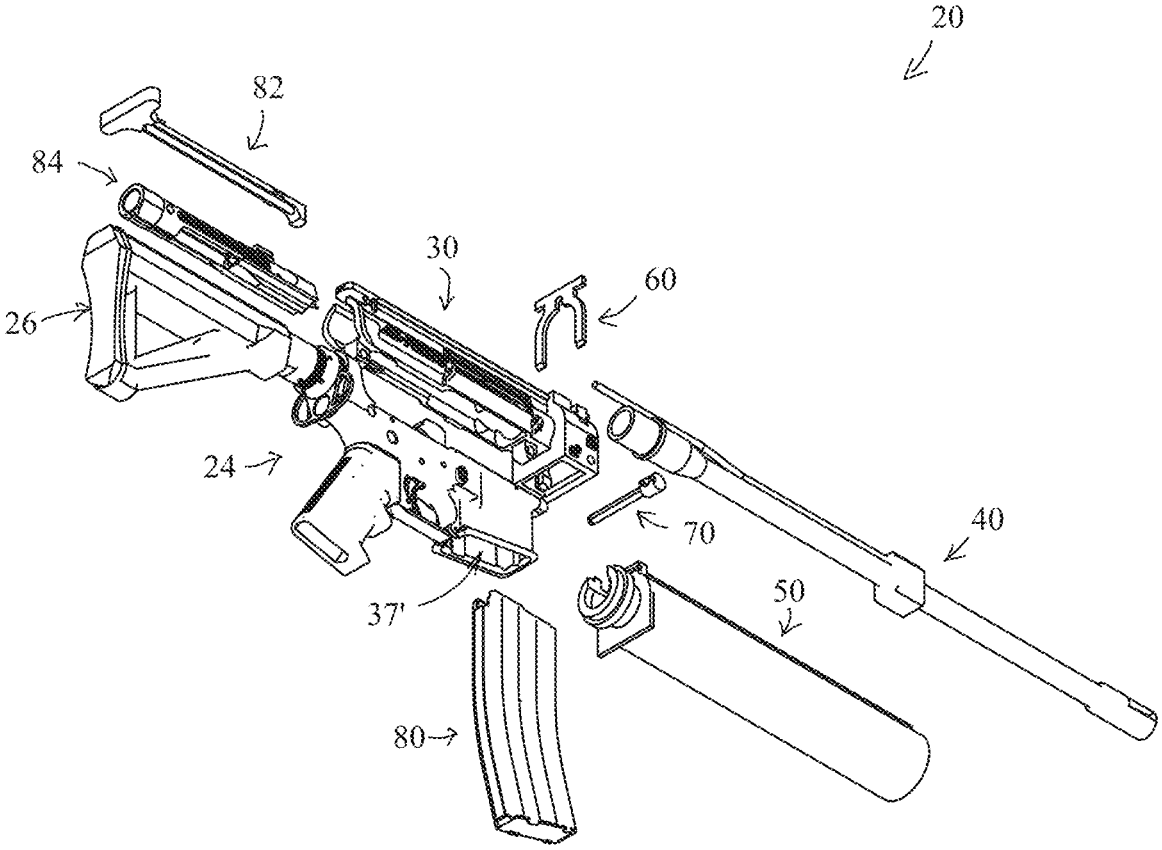
FIG. 3 is rear bottom exploded perspective view of the firearm of FIG. 1.

Referring to FIGS. 1-25 aspects of the firearms, firearm components, systems and methods of the invention are shown. FIG. 1 shows one aspect of a firearm 20. The firearm 20 may be of a rifle 20, or of an automatic rifle variety, or of a semi-automatic or single fire variety, or any weapon utilizing a barrel affixed to a receiver, including but not limited to breach load weapons, muzzle loaders, shotguns, mortars, recoilless rifles, cannons, light and heavy machine guns, and handguns. Firearm 20 as shown in FIG. 1 is of an AR-15 variety and includes a hand guard 50 connected to an upper receiver 30 with a barrel 40 extending from the upper receiver 30 and hand guard 50. The upper receiver is connected to a lower receiver 24. The lower receiver 24 includes a shoulder stock 26, a hand grip 27 and trigger 28. In aspects, a magazine 80 inserts into a magazine port 37' (See FIG. 3) of lower receiver 24. Magazine 80 holds ammunition. In one aspect a charging handle 82 and a bolt carrier group 84 insert into a stock end 33 of the upper receiver 30. FIG. 2 and FIG. 3 show firearm 20 in an exploded view, with barrel assembly 40 separated from the upper receiver 30 and separated from the hand guard 50. As explained herein, the barrel assembly 40 may be quickly and easily connected to and removed from the firearm 20, and a variety of different types of barrels or barrel assemblies 40 may be exchanged or replaced with the firearm 20 as desired. It may be appreciated that a variety of types of barrels 40 may be used with the AR-15 style of depicted firearm 20, and that different firearms, other than AR-15 varieties, may also be configured to receive different barrels or barrel assemblies.

Figure 4:
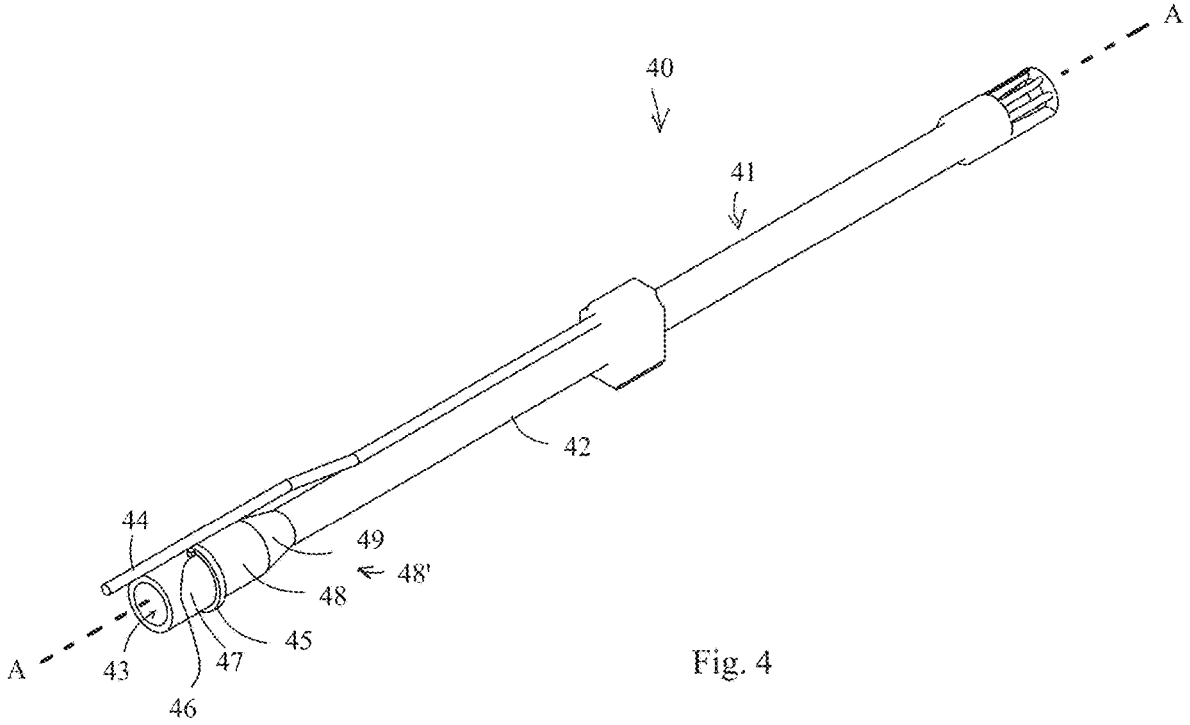
FIG. 4 is a perspective view of a barrel component for use with or as component of the firearm of FIG. 1.

FIG. 4 is a perspective view of a representative barrel assembly 40 for use with firearm 20 and firearm component 22. Barrel assembly 40 includes a barrel 41 having a tubular-shaped body 42 having a bore 43 running therethrough. Bore 43 defines a central axis along line A-A of FIG. 4. Ammunition is fired through the bore 43 of the barrel 41 as is common. In one aspect barrel assembly 40 includes a gas tube 44 which is commonly used in or with barrels 41 of an automatic or semi-automatic rifle variety. While the firearm 20 depicted in FIGS. 1-3 is of an AR-15 or similar variety showing a gas tube 44, a gas tube 44 is not always desired or required, such as when attaching a barrel 41 without a gas tube and instead with a bolt action mechanism or other mechanisms. Firearms use many different mechanisms to load, shoot, and reload the ammunition, and a majority of such firearms, when using the components, systems and methods represented in this AR-15 example can be reconfigured to allow a user to quickly and easily swap barrels.

In one aspect the gas tube 44 extends beyond a terminal end of the tubular body 42, opposite the output end of the barrel assembly 40. The gas tube 44 inserts into a companion tube within the upper receiver 30 to accommodate flow of gas. Barrel assembly 40 or barrel 41 includes a rim 45 or annular structure positioned about the tubular body 42 of barrel 41. Barrel assembly 40 or barrel 41 includes a chamber housing 48' comprising a hub 48 and taper 49 extending from the tubular body 42. Barrel extension 47 extends from the chamber housing 48'. The rim 45 is positioned between barrel extension 47 and chamber housing 48'. A barrel indexing pin 46 is positioned at barrel extension adjacent or abutting rim 45. Indexing pin 46 is configured to insert into a socket (barrel pin slot) within upper receiver 30. It is standard in the AR-15 industry that all barrel assemblies 40 or barrels 41 include a collar or rim 45 and a barrel extension 47 together with a barrel indexing pin 46. Such standard or common configurations allow the same to be universally interchanged among various firearms. The barrel assemblies 40 or barrels 41 may be of particular Mil-Spec or military specifications. The Mil-Spec barrel assemblies or barrels 41 work together with other Mil-Spec components of the AR-15 variety or other types of weapons and firearms. In one example, collar or rim 45 has a diameter greater than one inch, and in some cases has a diameter of 1.17 inches or 29.7 mm, and barrel indexing pin 46 raises upward about 0.12 inches or 3.05 mm from the barrel extension 47. In one aspect barrel extension 47 has a diameter of 1.00 inches and a length of 1.25 inches. In one aspect the distance from a terminal end of the barrel extension 47 to the barrel indexing pin 46 measures 0.8645 inches, or 21.958 inches. In aspects the barrel indexing pin 46, collar 45 and barrel extension 47 structure of AR-15 firearm barrels 41 are the same while the remaining aspects of the tubular body 42 and barrel 41 may be configured to accommodate a variety of types of ammunition by having varying bore diameters and structures and lengths. Such different barrel assemblies 40, barrels 41 and tubular bodies 42 may be configured to accommodate a variety of types of ammunition, including barrels 41 used to fire ammunition including but not limited to .350 Legend, .300 Blackout, 5.56 NATO, .223 Wylde, 7.62×39, 6.5 Grendel, 9 mm, .45 ACP, .40 S&W .22 LR and Magnum, .450 Bushmaster, .458 SOCOM, .224 Valkyrie, among others. Barrel 40 may also vary in length, such as 7.5 inches for an AR-15 pistol to 24+ inches for a rifle. Barrel assembly 40 or barrel 41 may also have a much shorter length when used in a hand gun variety of firearm. Barrel assembly 40 or barrel 41 may be made of metal or composites of metal, including but not limited to 410 and 416 stainless steel or 4140 and 4150 carbon steel. FIG. 4 shows gas tube 44 extending rearward from the rifled barrel 42. The gas tube 44 inserts into the upper receiver 30 to pass through or into a receiving channel therein (See also, FIG. 23B, FIG. 24). The barrel indexing pin 46 inserts into a corresponding opening within the receiver 30 and assists with proper and efficient alignment of the barrel assembly 40 or barrel 41 within the receiver 30. The barrel indexing pin 46 also causes the barrel assembly 40 to resist rotation once set within the receiver 30.

Figure 5:
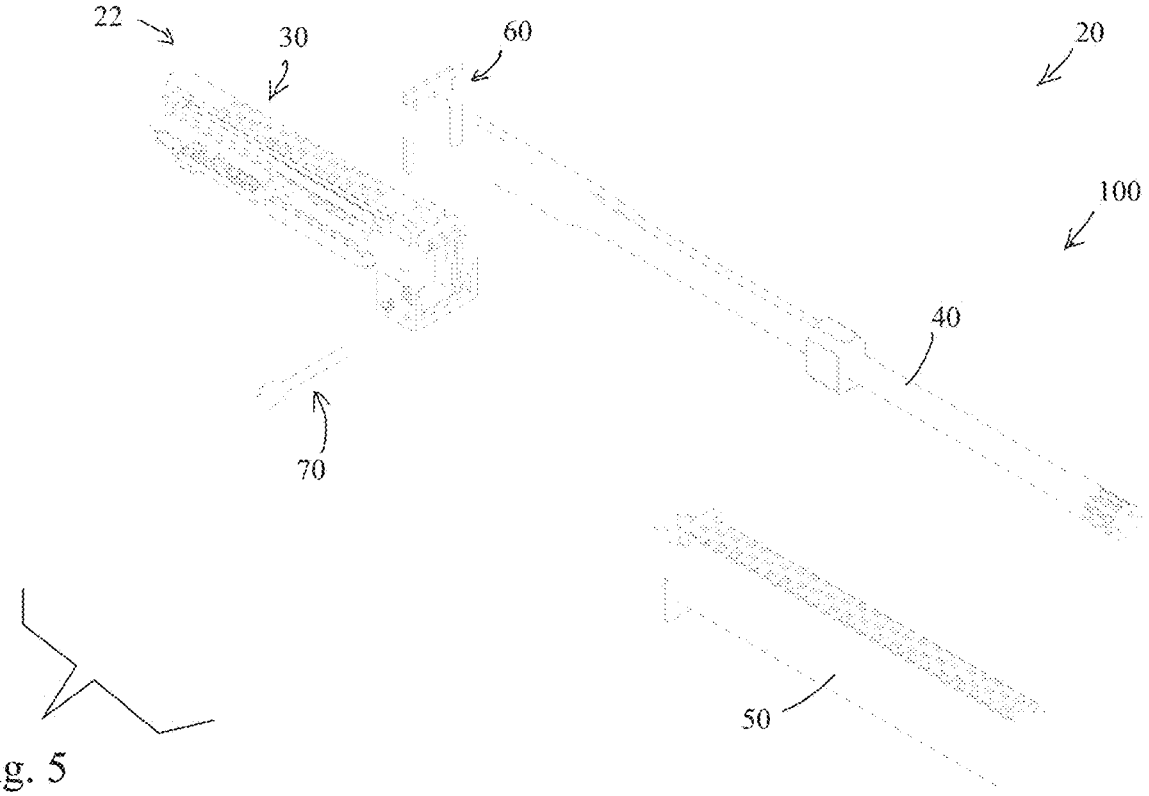
FIG. 5 is an exploded perspective view of a component or firearm of FIG. 1.
Figure 6:
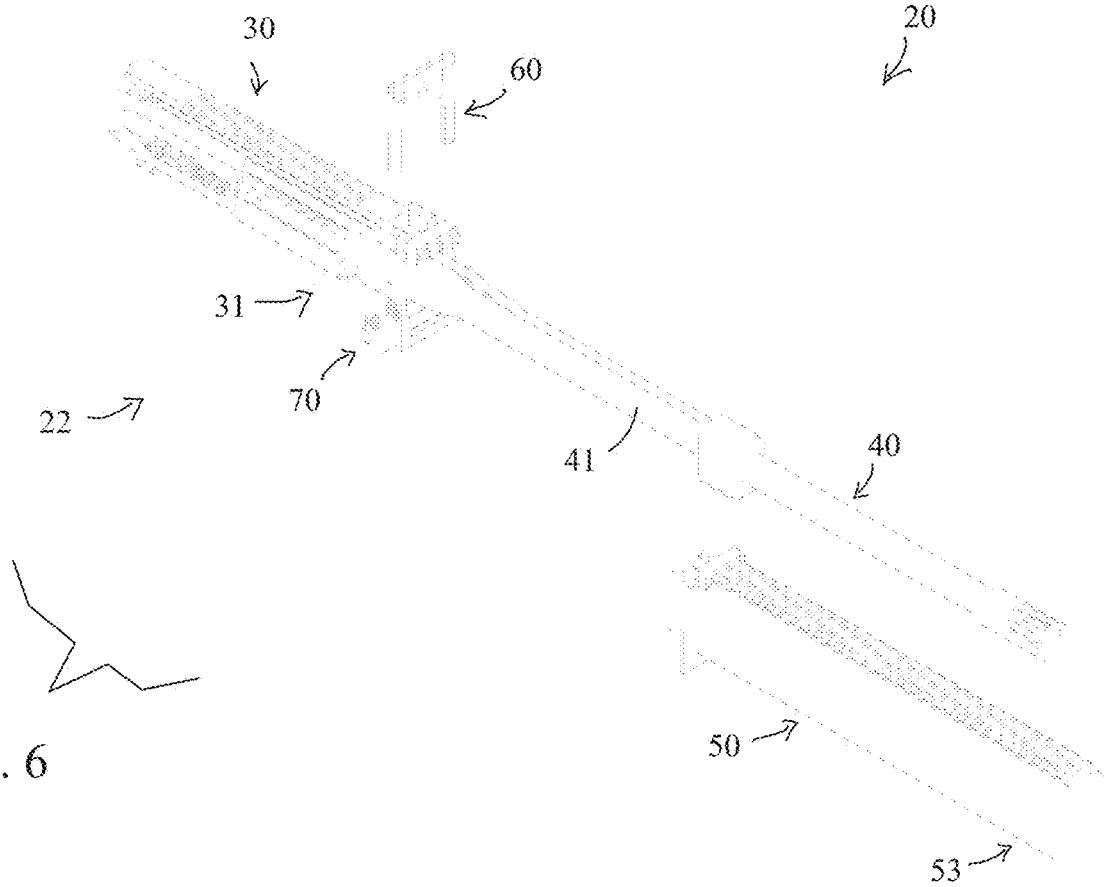
FIG. 6 is an exploded perspective view of a component or firearm of FIG. 1.
Figure 7:
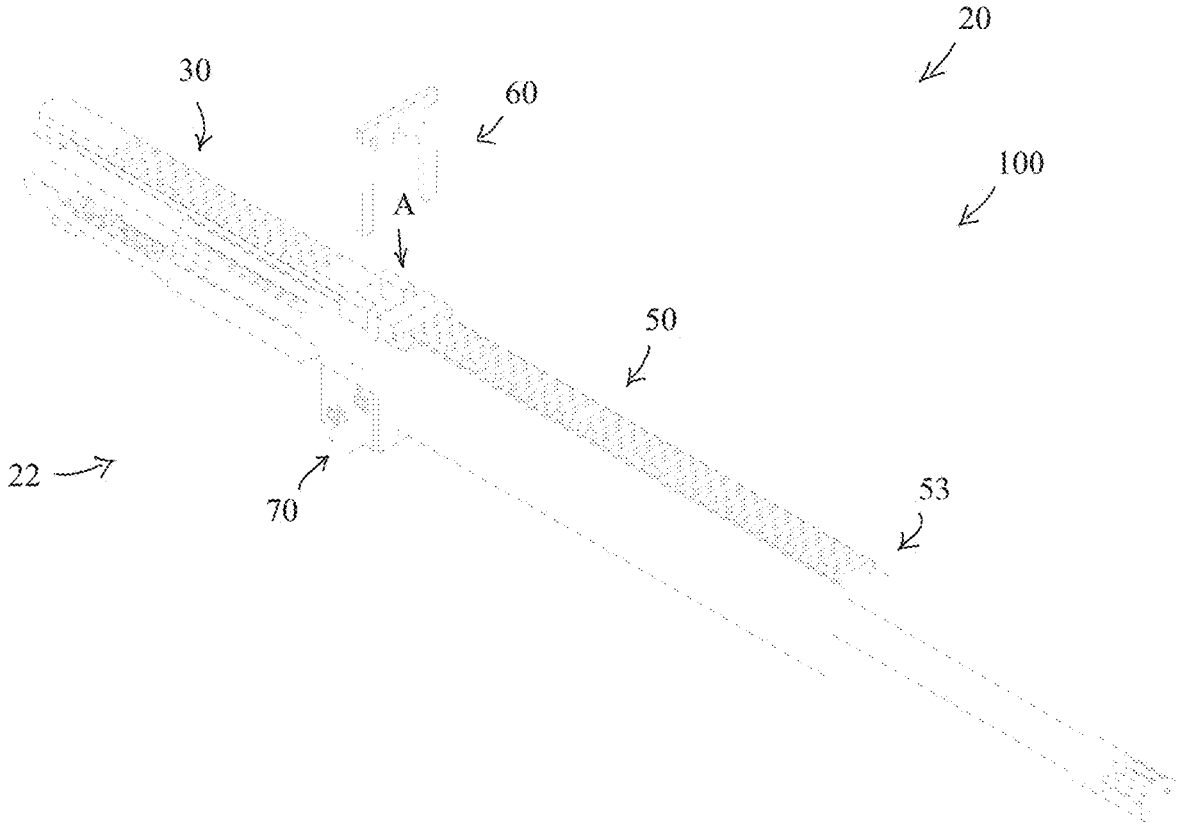
FIG. 7 is an exploded perspective view of a component or firearm of FIG. 1.
Figure 8:
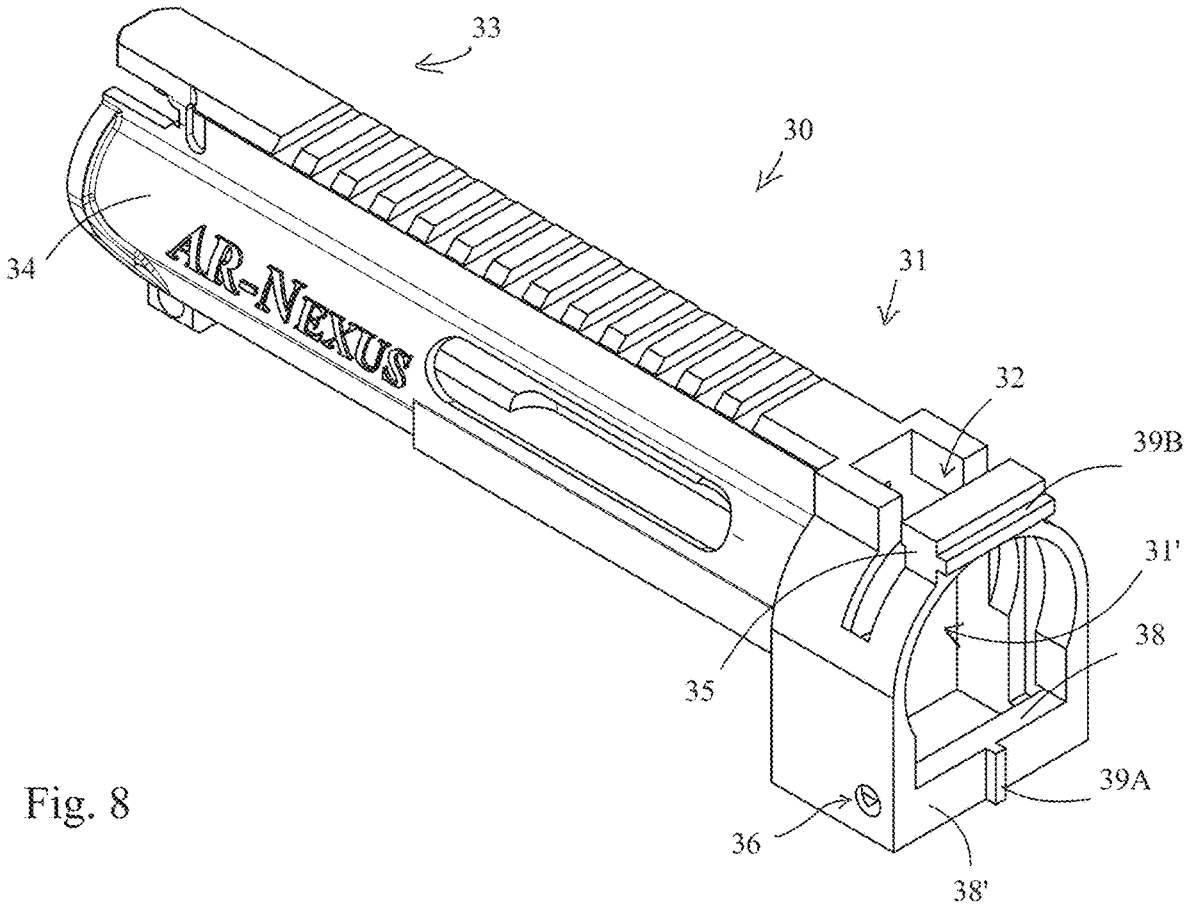
FIG. 8 is a perspective view of a component of FIG. 1.
Figure 9:
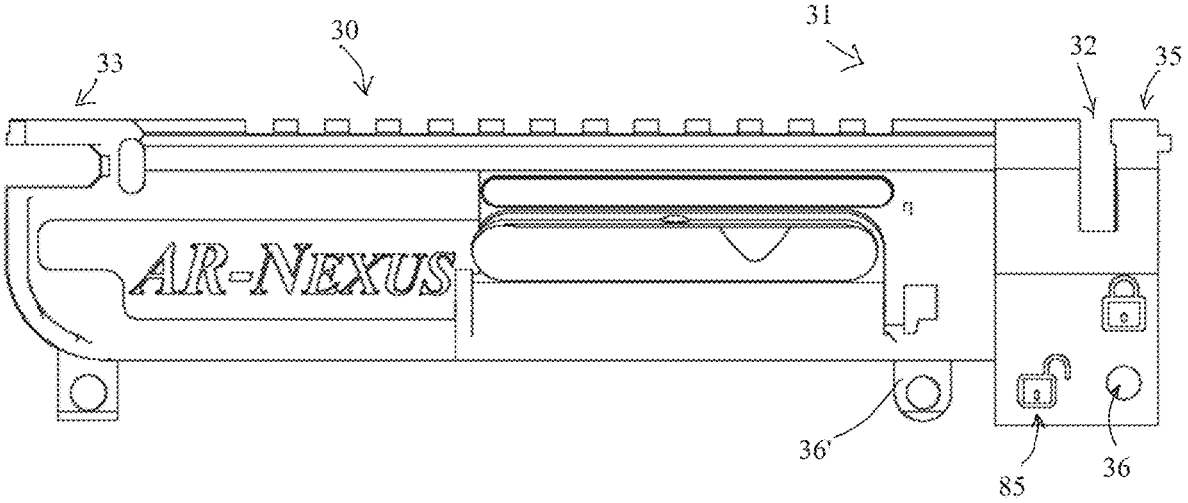
FIG. 9 is a side view of the component of FIG. 8.
Figure 10:
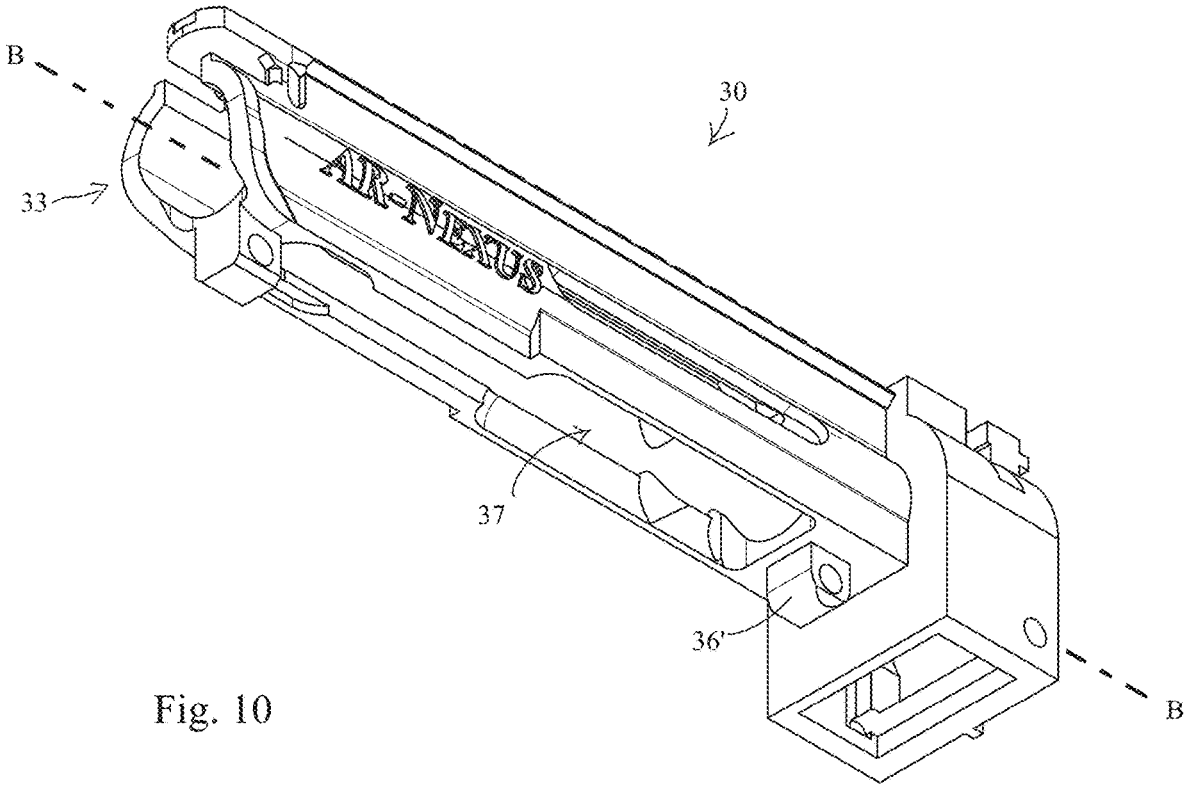
FIG. 10 is a rear perspective view of the component of FIG. 8.
Figure 11:
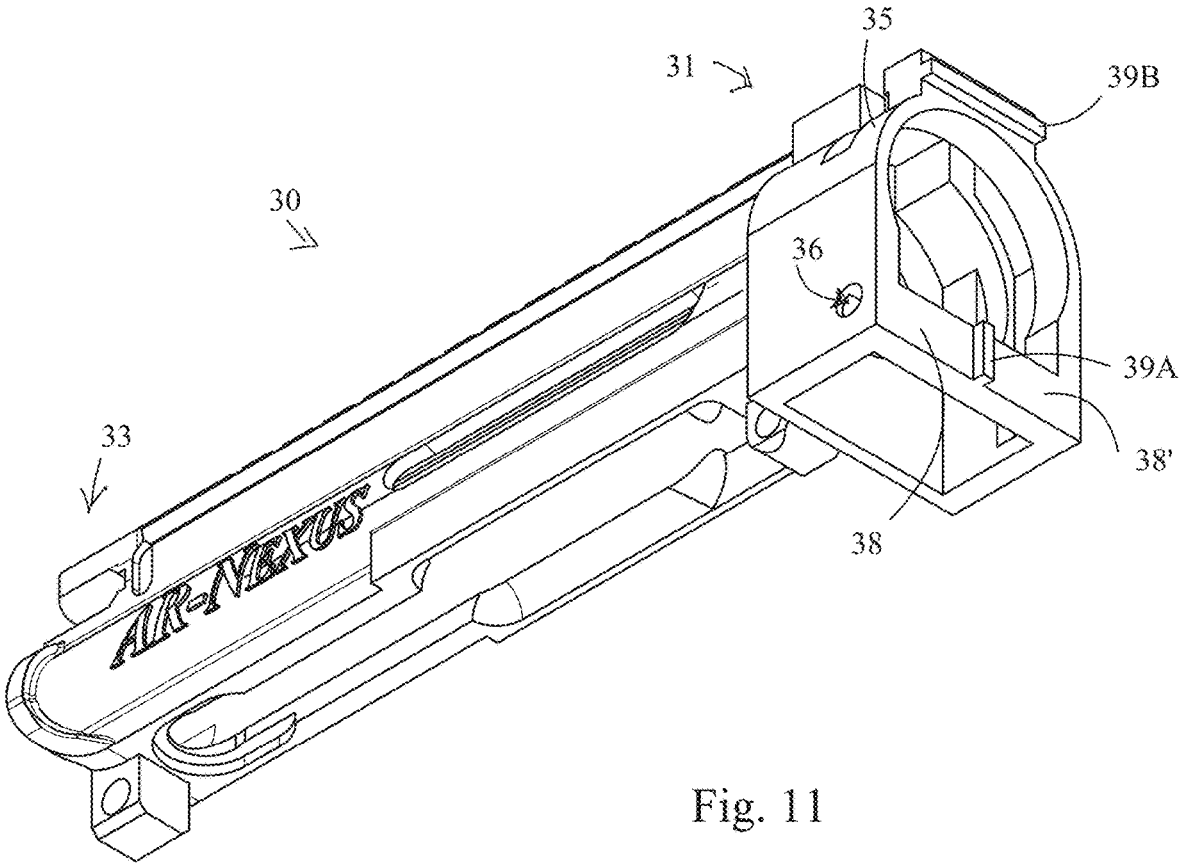
FIG. 11 is a bottom perspective view of the component of FIG. 8.
Figure 12:
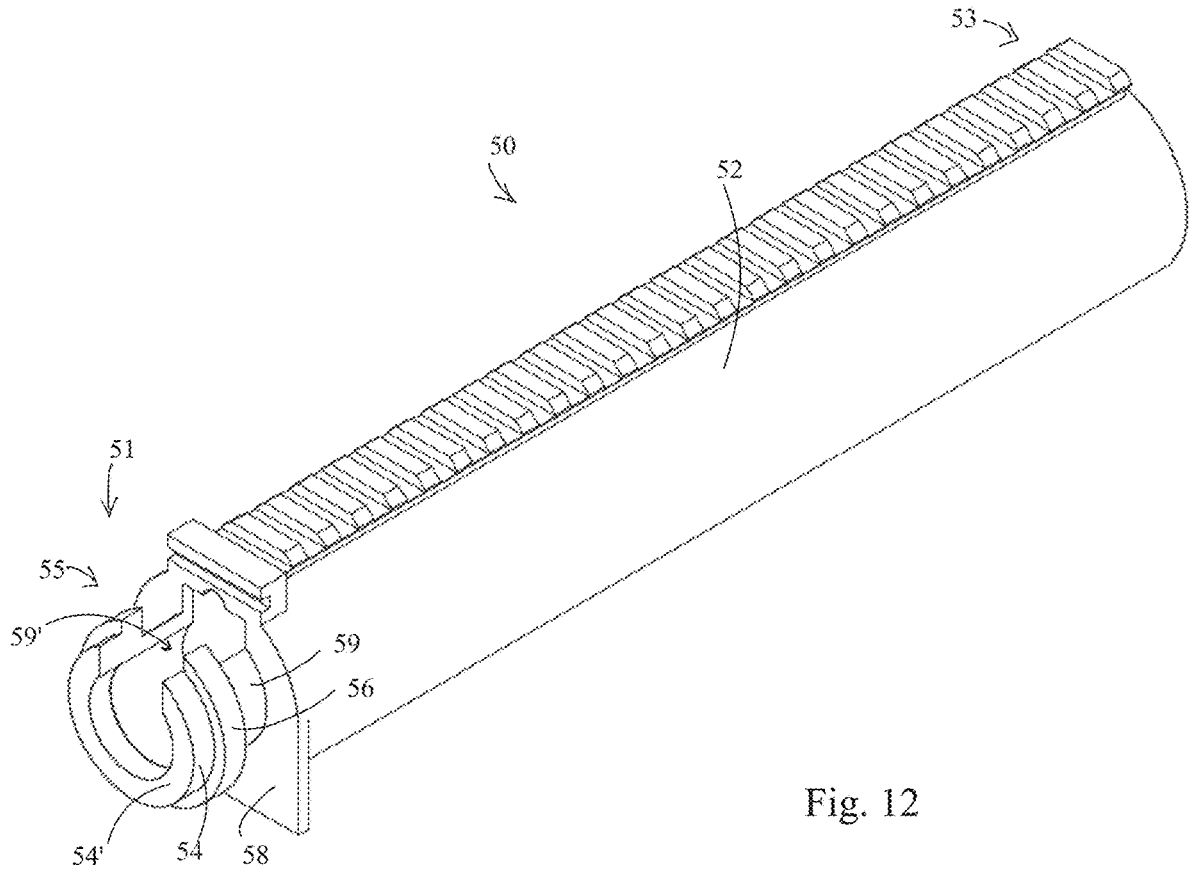
FIG. 12 is a perspective view of a component of FIG. 1.
Figure 13:
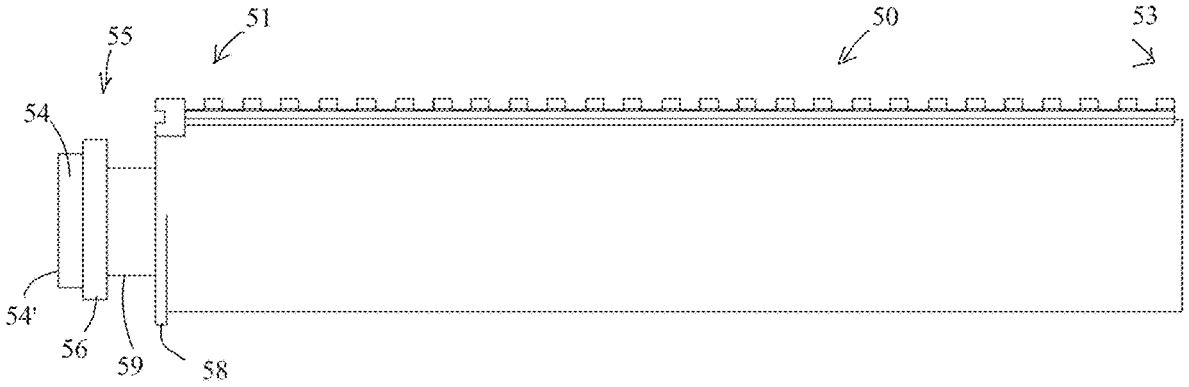
FIG. 13 is a side view of the component of FIG. 12.
Figure 14:
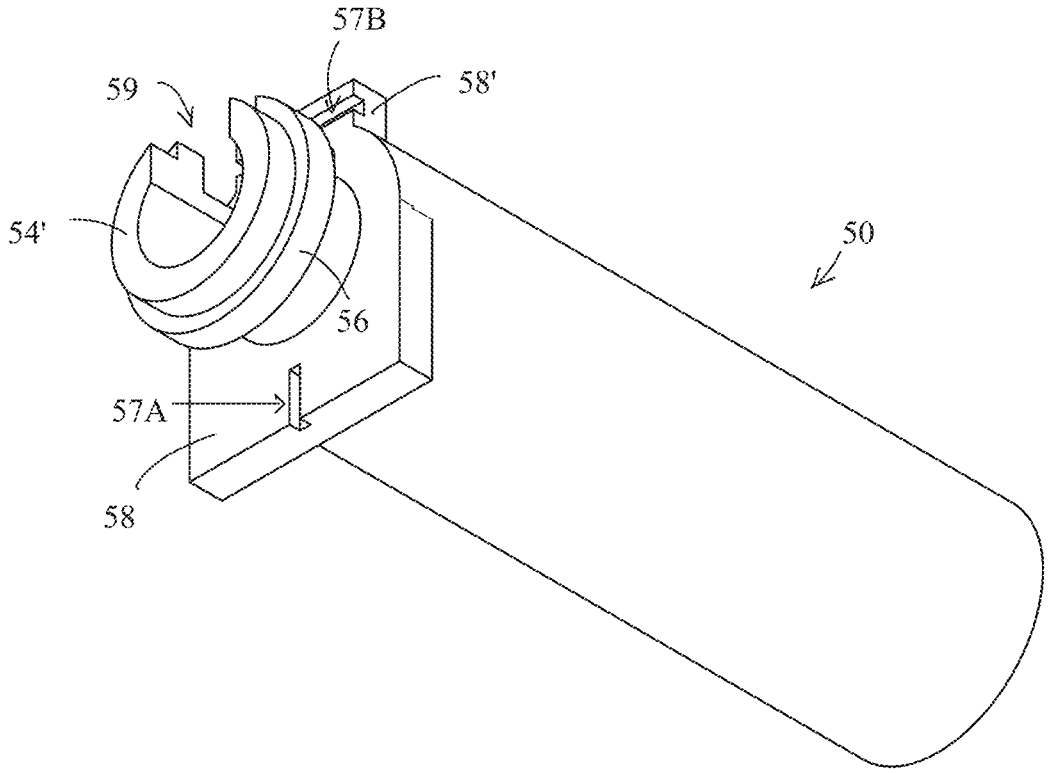
FIG. 14 is a bottom perspective view of the component of FIG. 12.
Figure 15:
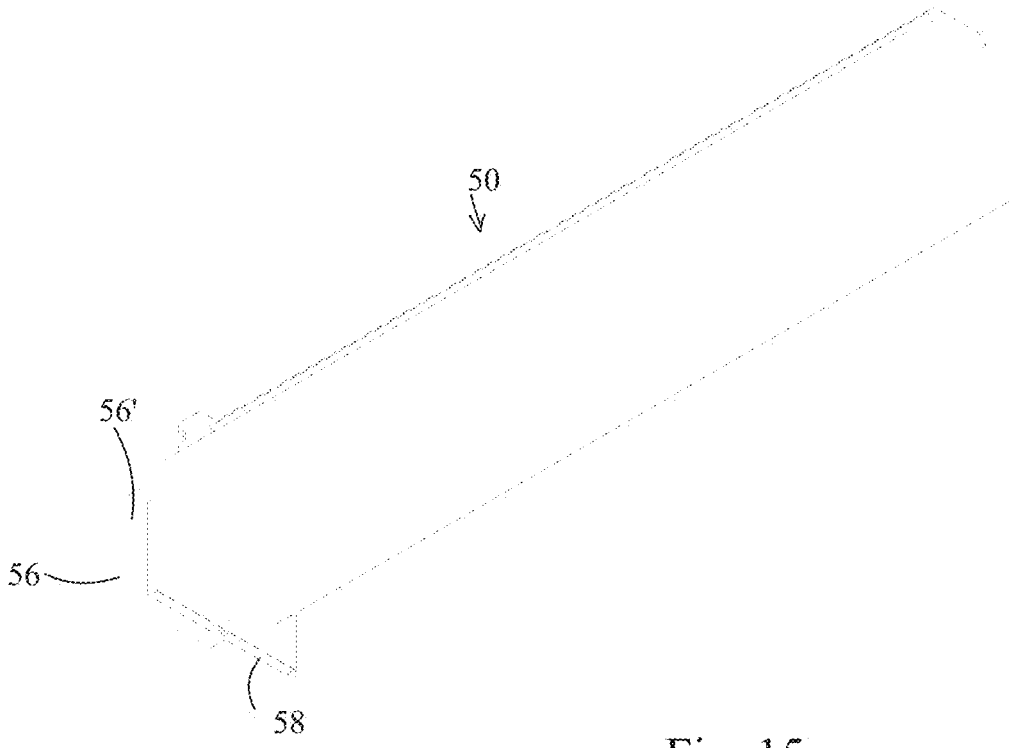
FIG. 15 is a bottom perspective view of the component of FIG. 12.
Figure 16:
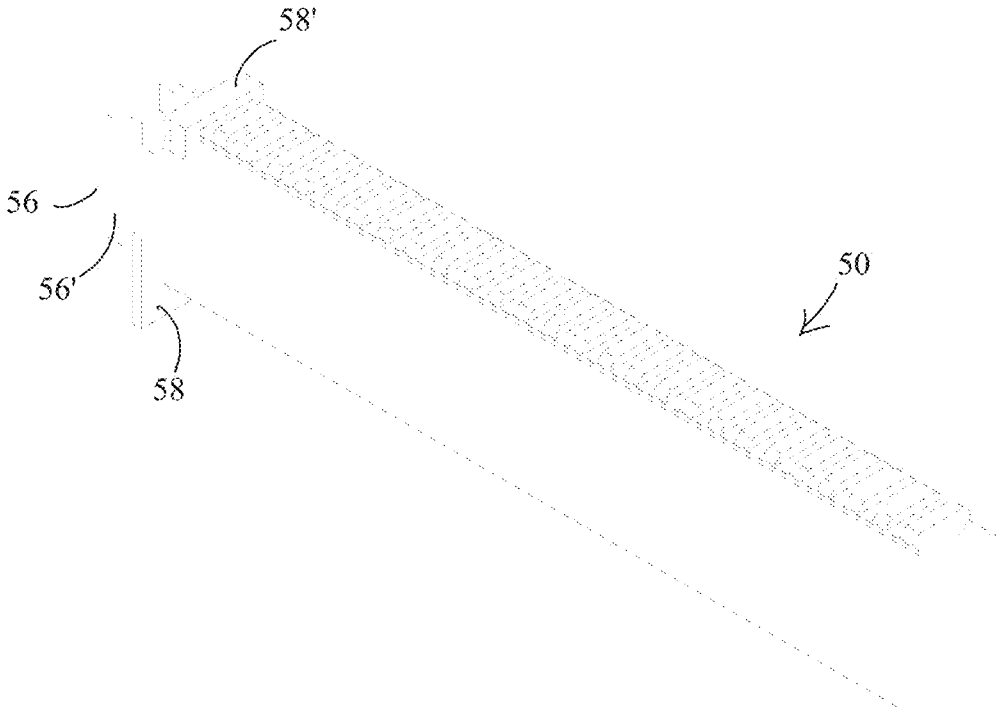
FIG. 16 is a perspective view of the component of FIG. 12.
Figure 17:
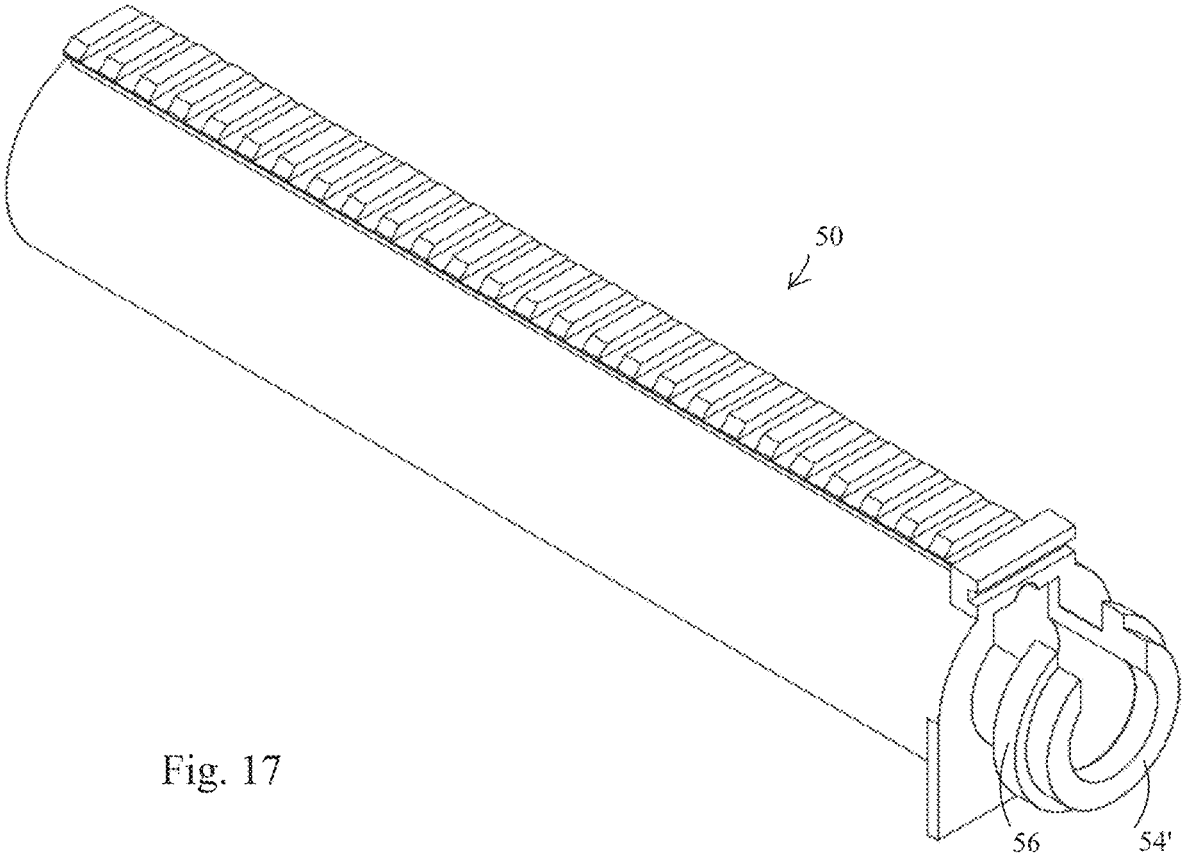
FIG. 17 is a perspective view of the component of FIG. 12.

FIGS. 5-7 show various stages of assembly of firearm 20 and/or firearm component 22, including methods 100 of assembly. FIG. 5 is an exploded view of firearm component 22 having an upper receiver 30, hand guard 50 and spring 60. The firearm component 22 is configured to receive a variety of types of barrel assemblies 40 or barrels 41, which may be easily and quickly connected to component 22 and replaced with a different barrel 41 or barrel assembly 40. FIG. 6 shows upper receiver 30 with a barrel 41 and/or barrel assembly 40 inserted in a barrel end 31 of receiver 30. A spring 60 is poised to be inserted into the receiver to secure the barrel 40 into position. A pin 70 inserts into the receiver to lock the barrel 40 into the receiver 30, as explained in further detail below. FIG. 7 shows hand guard 50 poised to be secured to upper receiver 30, with barrel 40 extending outward through an output end 53 of the hand guard. The hand guard 50 is also locked into position with the receiver 30, as explained in further detail below.

FIGS. 8-11 present various close-up views of upper receiver 30. In aspects, receiver 30 includes a generally tubular body 34 having a cavity or bore extending from a barrel end 31 through to a stock end 33. A spring cavity 32 is defined with an opening at a top portion of the receiver 30 toward or at the barrel end 31. An ammunition port 37 is located at an underside of the receiver 30 and is configured to receive ammunition such as ammunition from the magazine 80. The stock end 33 of the upper receiver 30 is configured to receive the charging handle 82 and bolt carrier group 84. Receiver 30 includes a pivot 36' having a hole which receives a pivot pin 29 of the lower receiver 24 (See FIG. 10 and FIG. 2) which allows upper receiver 30 to pivot upwards from lower receiver 24 to expose the openings for receiving the charging handle 82 and bolt carrier group 84. At barrel end 31 the upper receiver 30 includes a receiver head 35 and receiver foot 38. The spring cavity 32 forms a gap between receiver head 35 and the rearward portion of barrel end 31. A receiver foot 38 is positioned below receiver head 35. Receiver foot 38 includes a face 38' which mates with hand guard 50. An alignment rib 39A extends from face 38' to assist in alignment and structural support of the hand guard 50. An alignment rib 39B is positioned at receiver head 35 to also mate with hand guard 50 to accommodate alignment and structural support and mating of the components. Receiver 30 includes a pin hole 36 which passes transverse the generally oriented bore through the receiver, and is configured to receive a locking pin 70 as described below. Upper receiver 30 is made of metal, such as aluminum or steel or other metal, and may also be made of other materials or composites or alloys. Receiver 30 defines a bore 31' in which is inserted the barrel assembly 40 and/or barrel 41 and a portion of the hand guard 50 as described herein. Bore 31' defines a central axis along line B-B of FIG. 10. It may be appreciated that in aspects central axis of bore 31' of receiver 30 aligns along central axis of bore 43 of barrel 40.

FIGS. 12-17 present various close-up views of hand guard 50. In aspects, hand guard 50 includes a generally tubular body 52 defining a bore running therethrough. Hand guard 50 includes a receiver end 51 which connects to the upper receiver 30 and an output end 53 through which the bore is aligned. At the receiver end 51 is a connecting portion 55 for connecting the hand guard 50 to the upper receiver 30. The connecting portion 55 extends from mating wall 58 of tubular body 52 and includes a tubular-like shaped neck 59 followed by a collar 56 which in one aspect is a partial annular ring having diameter greater than a diameter of the neck 59, followed by a head 54 having a terminal end 54'. Head 54 is also tubular-like shaped having a diameter smaller than a diameter of the annular-like ring or collar 56. Connecting portion 55 inserts into the bore 31' (See FIG. 8) of upper receiver 30. A gap 59' is defined by the connecting portion 55 to allow clearance for portions of the barrel assembly 40, such as clearance for the gas tube 44, when hand guard 50 is inserted over the barrel 40 and within receiver 30. Particularly, the gap 59' is defined in part by an upper aspect of the neck 59, collar 56 and head 54. Collar 56 is positioned at the connecting portion 55 in a spaced relation from mating wall 58. The space between collar 56 and mating wall 58 allows for insertion of receiving spring 60 as further described herein. In one aspect mating wall 58 may also include alignment groove 57A. An additional alignment groove 57B is defined by upper mating wall 58'. Mating wall 58 is configured to abut and mate with receiver foot 38 at face 38' of receiver 30, with alignment groove 57A receiving alignment rib 39A. Upper mating wall 58' is configured to abut and mate with receiver head 35, with alignment groove 57B receiving alignment rib 39B. Such mating enhances the quick alignment and stable connection between hand guard 50 and receiver 30, and inhibits twisting between those components. The alignment features also allow for quick, confident and precise insertion of the hand guard 50 onto the receiver 30 for proper alignment. In one aspect hand guard 50 is a unitary component made of a single material such as metal, and may also be made of other materials including metal alloys, plastics or combinations of materials. In some aspects hand guard 50 may include ventilation apertures and a variety of gripping ribs which also assist in dissipation of heat and handling of the firearm.

Figure 18:
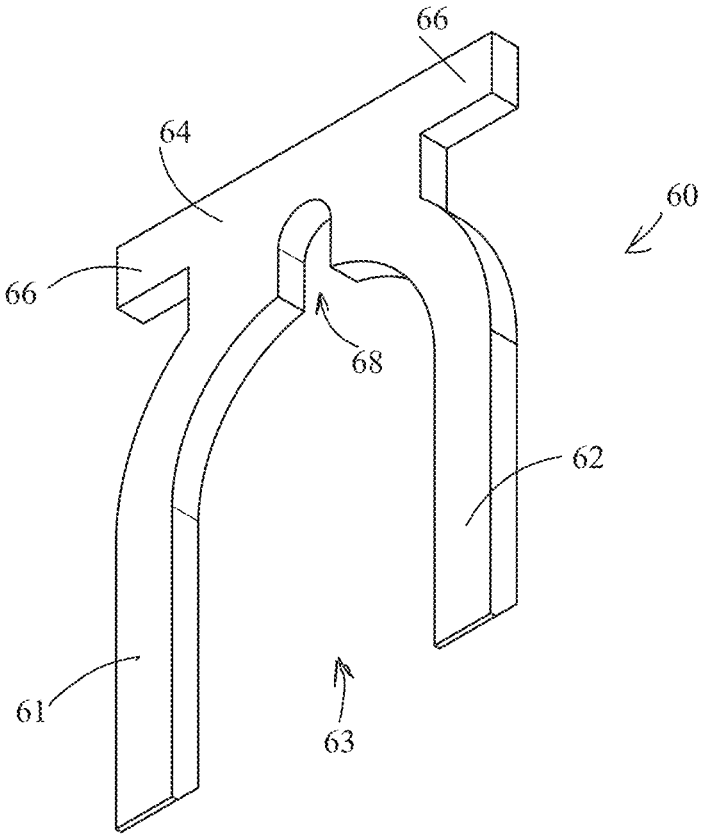
FIG. 18 is a perspective view of a component of FIG. 1.
Figure 19:
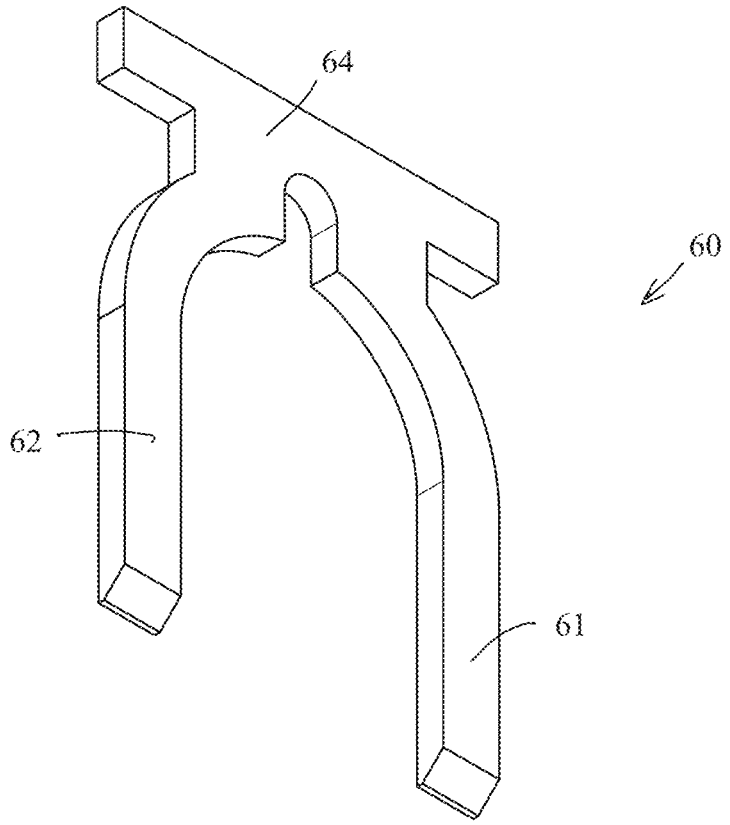
FIG. 19 is a rear perspective view of the component of FIG. 18.

FIGS. 18-22 present various close-up views of spring 60 and pin 70. As shown in FIG. 18, spring 60 is generally U-shaped having a pair of tines 61, 62 extending from a base 64. The tines 61, 62 define a barrel gap 63 which allows spring 60 to insert into spring cavity 32 while straddling hub 48 of barrel 40. In one aspect tines 61, 62 are spaced apart 1.25 inches or 31.75 mm, and extend about 1 inch from base 64. Spring 60 further defines a tube gap 68 configured to provide clearance from the gas tube 44 when the spring is inserted into the upper receiver 30 at spring cavity 32. Spring 60 includes a pair of finger wings 66 to accommodate finger gripping of the spring 60 for easy insertion and removal of the spring 60 from the upper receiver 30. Once inserted, the finger wings 66 of the spring 60 extend partially outward (See FIG. 24) from an upper aspect of the body 34 of the upper receiver 30. In one aspect spring 60 has a thickness of about 0.125 inches or about 3.174 mm. In aspects, spring 60 is a leaf spring. Spring 60 is made of spring steel, which allows for flexing of spring 60 with memory for return to its original form.

Figure 20:
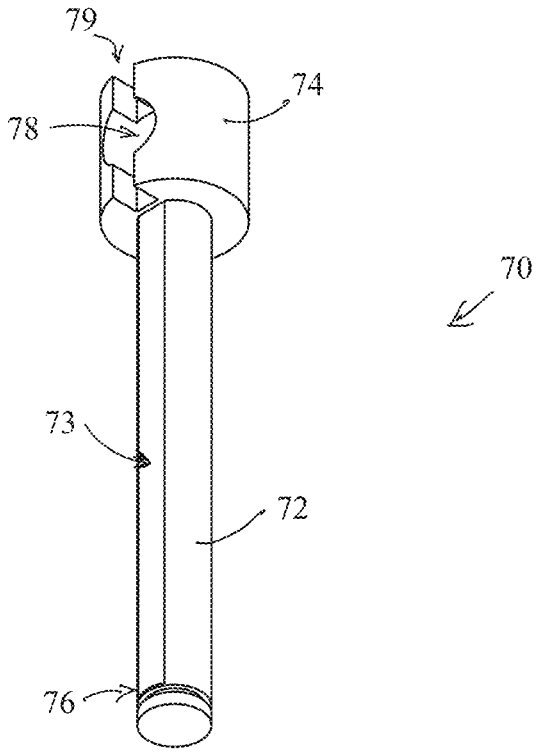
FIG. 20 is a perspective view of a component of FIG. 1.
Figure 21:
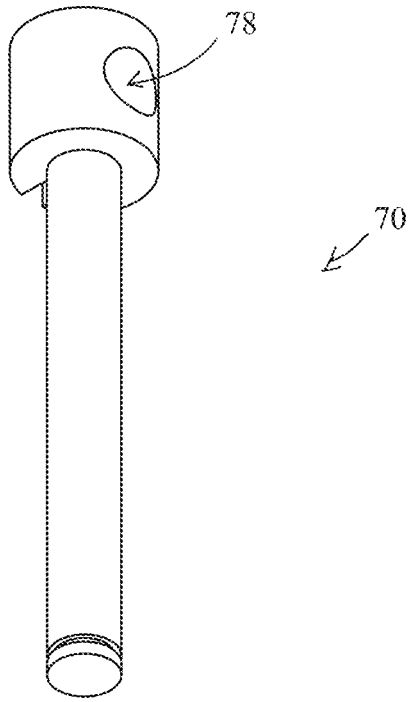
FIG. 21 is a further perspective view of the component of FIG. 20.
Figure 22:
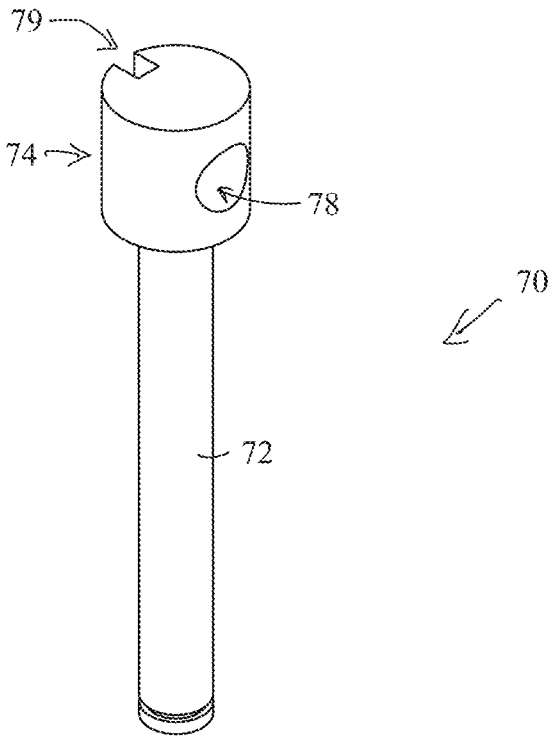
FIG. 22 is a further perspective view of the component of FIG. 20.

FIGS. 20-22 show a cam or pin 70 which is configured to insert into pin hole 36 of upper receiver 30. Cam or pin 70 operates as a cam to press against spring 60 as described in further detail below. In one aspect, pin 70 has a generally cylindrical body 72 having a pin head 74 at one end and a pin groove 76 at an opposite end of the body 72. In one aspect, pin body 72 includes a flattened portion 73. Pin head 74 defines a pin bore 78 through which may be inserted an object to help turn the pin to apply or release pressure on the spring 60. Pin groove 76 is configured to receive a retainer clip, spring clip, C clip washer or other retainer to secure pin 70 into position. Pin slot 79 is used as an indicator to clearly designate that the cam pin 70 is in position to apply pressure to the spring 60 and lock all parts together or release pressure on the spring 60 for disassembly. In one aspect pin slot 79 aligns with or corresponds with flattened portion 73, so that when cam 70 is inserted within upper receiver 30, a user will appreciate the orientation or positioning of the flattened portion 73 by viewing the orientation or position of the pin slot 79. In further aspects, upper receiver 30 includes indicia or graphics 85 (See FIG. 9, FIG. 23D) to assist a user in determining if the cam 70 is in a locked or unlocked position, i.e., if the pin slot aligns with indicia 85 showing an unlocked lock graphic, the operator will appreciate the pin 70 is in the unlocked position (with the flattened portion 73 facing the spring 60 and applying zero or minimal pressure to the spring 60). Likewise, if the pin slot 79 aligns with indicia 85 showing a locked lock graphic, the operate will appreciate the pin 70 is in the locked position (with the flattened portion 73 facing other than toward the spring 60 so that the remainder of the pin body 72 is applying force to the spring 60.

Figure 23A:
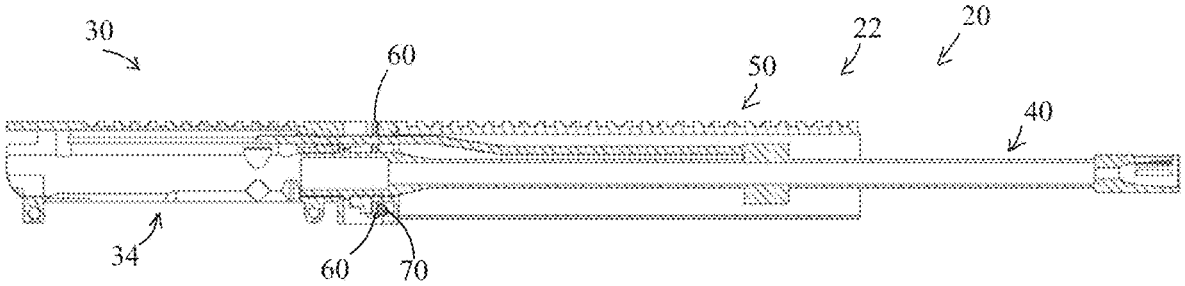
FIG. 23A is a section view taken along line 23-23 of FIG. 1.
Figure 23B:
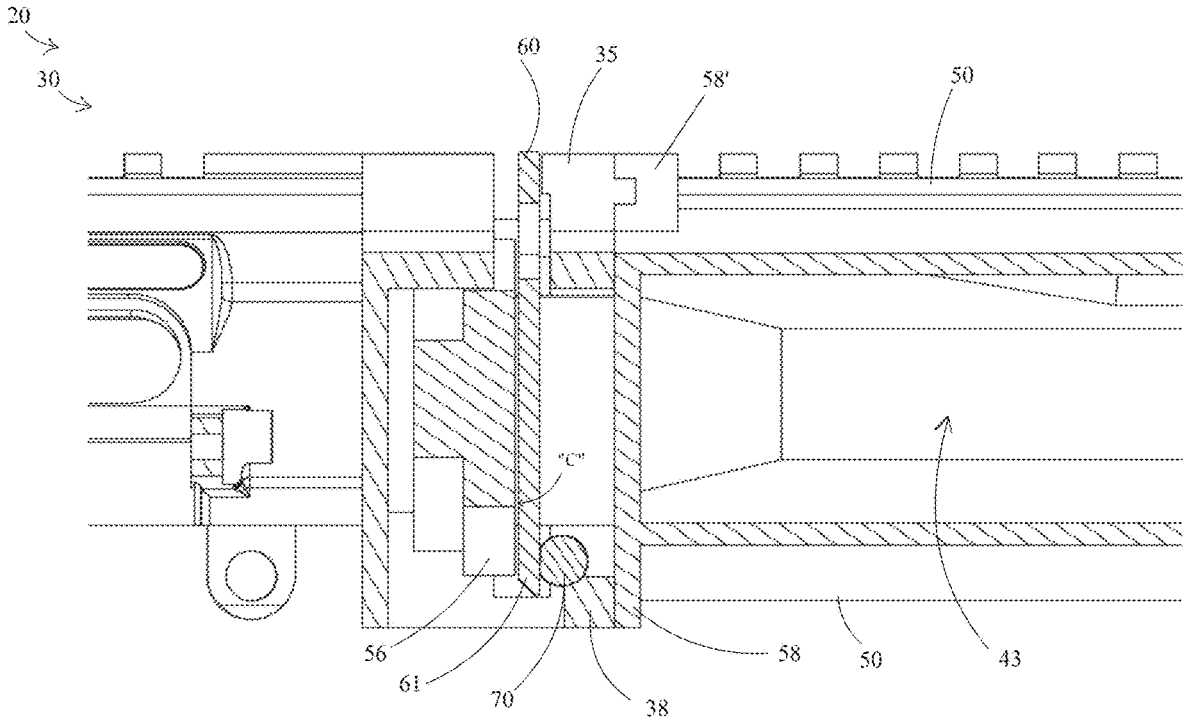
FIG. 23B is a partial section view of the firearm, component, system and method of FIG. 1, taken through a tine of a spring component of the invention.
Figure 23C:
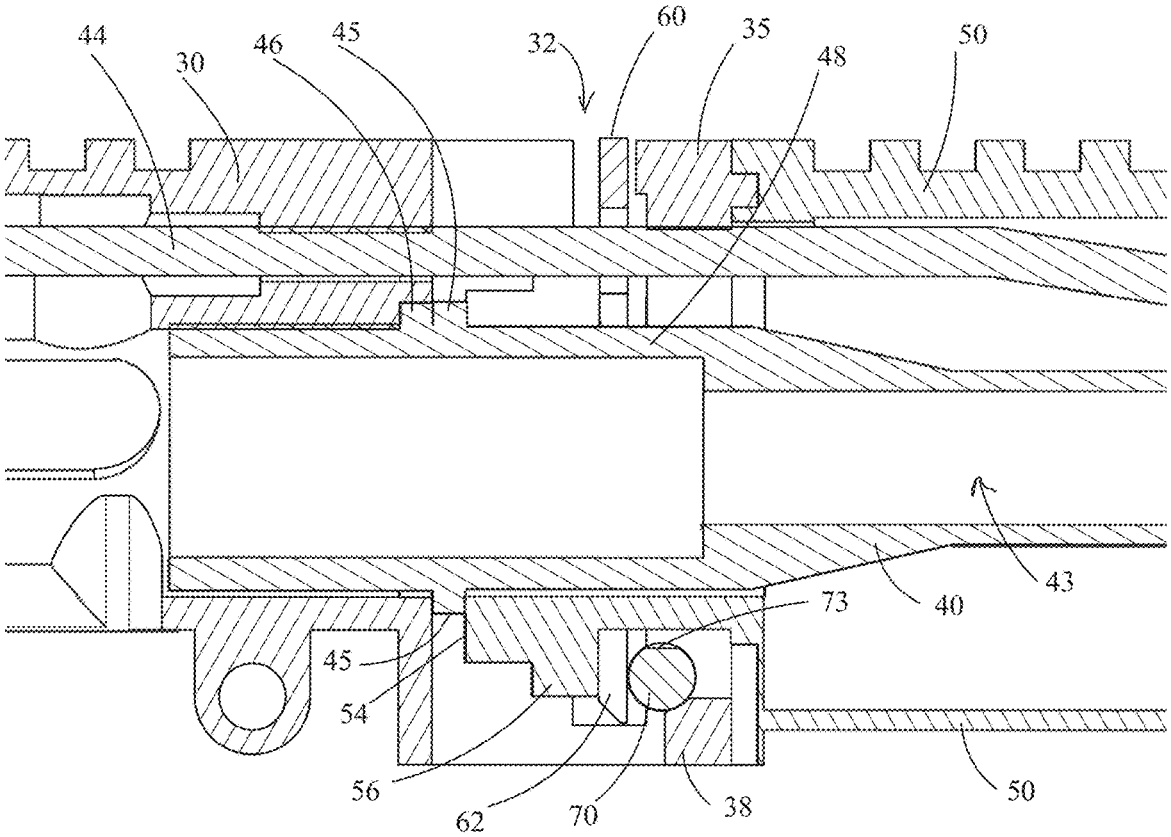
FIG. 23C is a partial section view taken along line 23-23 of FIG. 1.

FIGS. 23A, 23B, 23C and FIG. 24 show various cross-section views of firearm 20, components 22, systems and method aspects of the invention. FIG. 23A is a partial section view taken along a longitudinal center line, or line 23-23, of FIG. 1. The barrel assembly 40 and/or barrel 41 has been inserted into the upper receiver 30, with the hand guard 50 inserted over the barrel 41 where the hand guard 50 is also secured into the upper receiver 30. Particularly shown with respect to FIG. 23B, pin 70 is inserted into receiver 30 with the flattened portion 73 facing toward the stock end 33 of the upper receiver 30. Spring 60 is inserted into spring cavity 32 and tines 61, 62 straddle the hub 48 of the barrel 40. The tines 61, 62 extend downward and are configured to abut against collar 56, which in turn abuts against rim 45 of barrel assembly 40 or barrel 41. The pin 70 may be inserted prior to insertion of barrel 40, and prior to insertion of hand guard 50 and prior to insertion of spring 60, or at any time after insertion of those items. When inserting pin 70 prior to spring 60, it may be necessary to orient the flattened portion 73 toward the stock end 33 of the upper receiver 30 in order to have clearance for the insertion. In some cases, and in order to insert the spring into the receiver 30, the flattened portion 73 should also be oriented to face the stock end 33 to allow for clearance. FIG. 23B shows the spring 60 inserted into the spring cavity 32 while the flattened portion 73 of pin 70 is facing the stock end 33 of upper receiver 30 and also facing the tines 61, 62 (tine 62 is hidden from view on this cross-section taken through tine 61). A small gap or clearance "C" is shown between tine 61 of the spring 60 and collar 56 of the hand guard 50. Thus, there is no pressure exerted by the spring 60 against the hand guard 50 or barrel assembly 40. FIG. 23C is a partial section view taken along the midline or longitudinal section of line 23-23 of FIG. 1. The tine 62 of spring 60 is shown to abut against collar 56. Notice there is no clearance "C" between tine 62 and collar 56. Rotation of the pin 70 in a clockwise manner causes the pin body 72 to press against the spring 60 (i.e., the non-flattened portion 73 of pin 70 presses against the tines 61, 62) to lock the barrel assembly 40 within the upper receiver 30. Particularly, rotation of pin 70 causes a camming action due to the increased diameter of the pin 70 abutting against the spring 60. Turning the pin head 74 (whether clockwise or counter-clockwise) causes the pin body 72 to turn and press against the spring 60, thereby causing the collar 56 of the hand guard 50 to press against and retain the rim 45 of the barrel 41 in position. More particularly, rotation of pin 70 causes tines 61, 62 to press against the inward face 56' of the hand guard 50, which in turn causes the terminal end 54' of the head 54 of the hand guard 50 to press against the rim 45 of the barrel 40. Such rotation of the cam 70 locks the barrel 40 into the upper receiver 30. The barrel 40 cannot be removed unless the cam 70 is rotated to allow removal of the spring 60 and removal of the hand guard 50. The cam 70 is oriented transverse the central axis of the bore 43 of the barrel 40. In one aspect the cam 70 rotates along an axis perpendicular the central axis of the bore 43 of the barrel 40. In aspects, the pinhole 36 defines a central axis therethrough which is perpendicular the central axis of the bore 31' and the central axis of the bore 43. The central axis defined by pinhole 36 is positioned below the central axis of bore 31'. It may be appreciated that cam 70 may operate as a cam with other than a flattened portion 73, such as where a cross-section of the pin body 72 is other than circular, including but not limited to a cross-section that is eccentric, oblong, or other varying function.

Figure 23D:
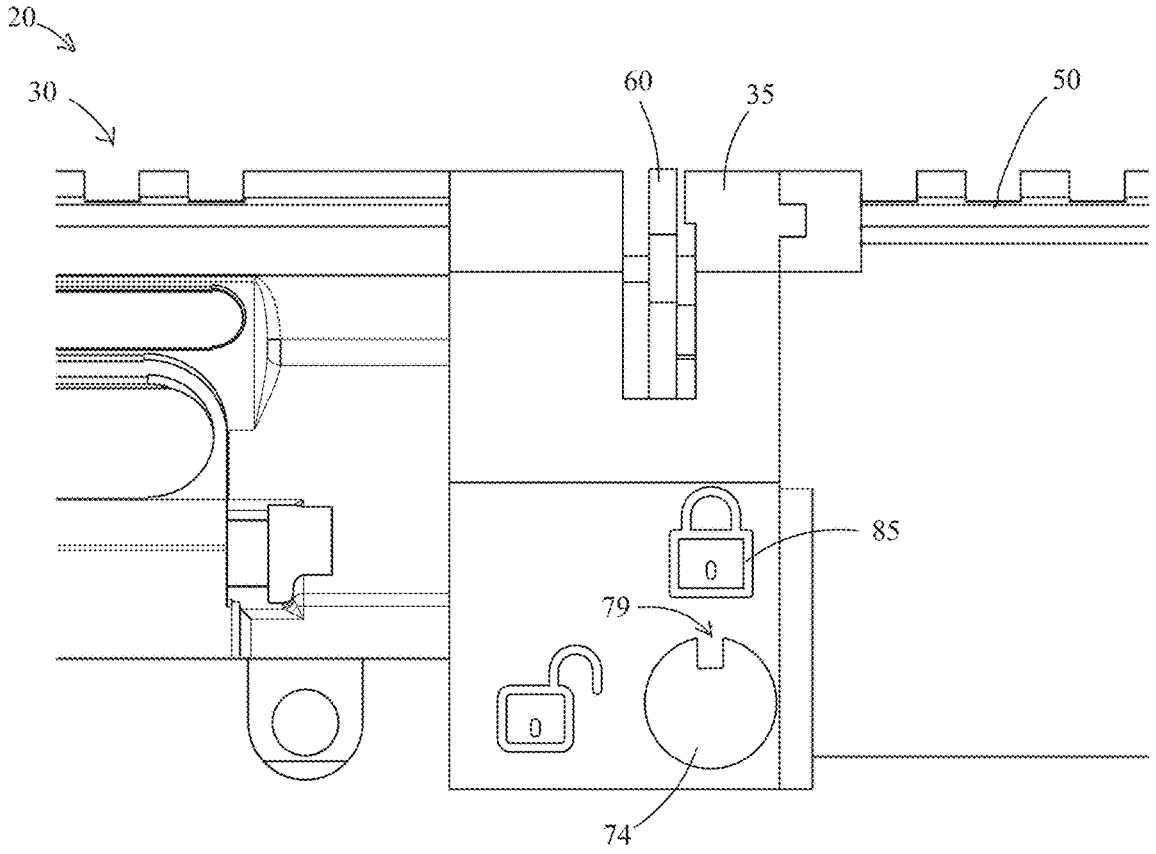
FIG. 23D is a partial side view of the firearm, component, system and method of FIG. 1.
Figure 24:
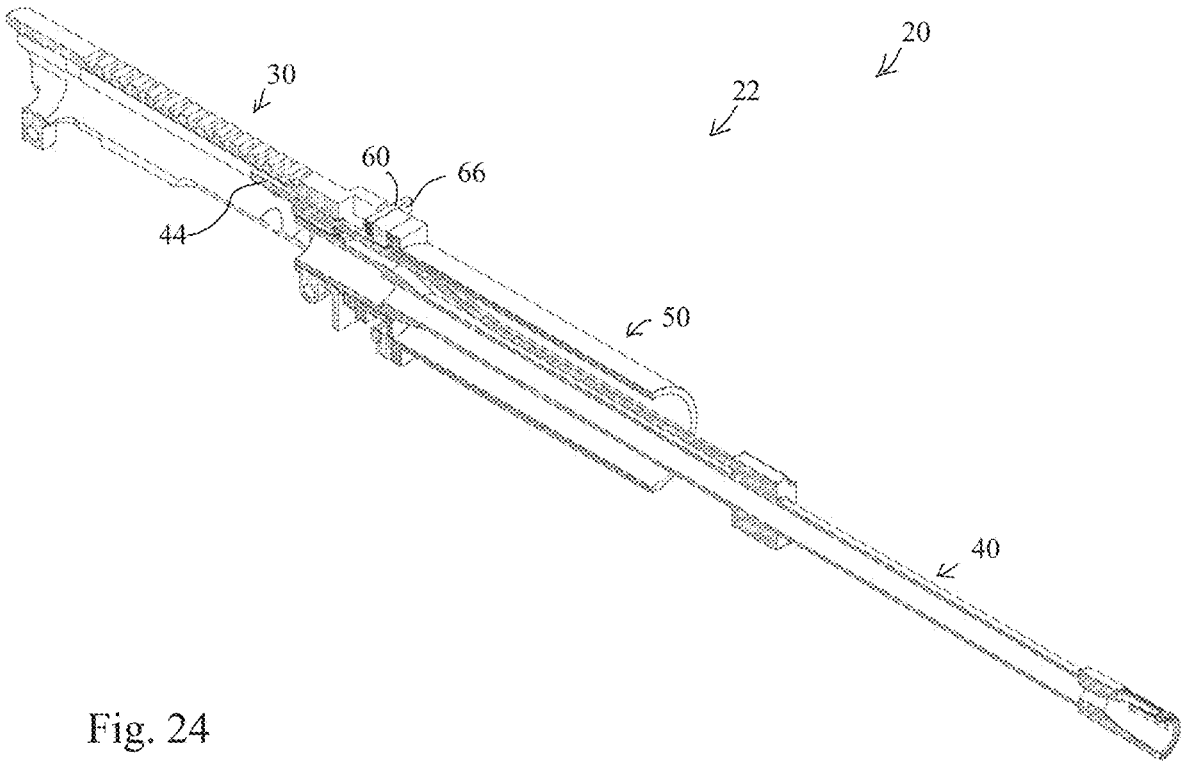
FIG. 24 is a perspective section view taken along line 23-23 of FIG. 1.
Figure 25:
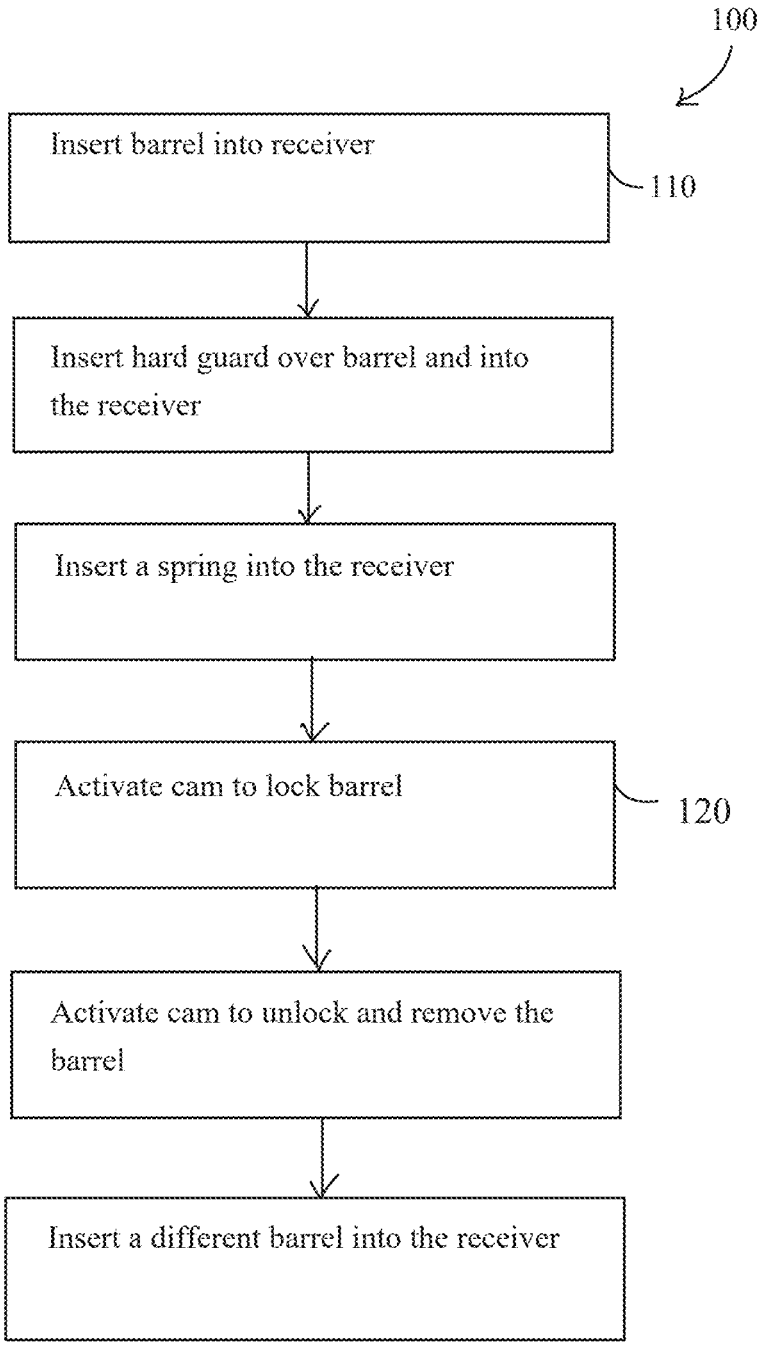
FIG. 25 is a flow diagram of further method aspects of the invention.

In one aspect operation of the cam 70 simultaneously locks into position the hand guard 50 and the barrel 40. In other aspects it may be appreciated that use of cam 70 (or multiple cams 70) may be alternatively configured to lock in either the hand guard 50, or the barrel 40, independently (with or without a spring 60). In further aspects, the cam 70 may be oriented generally horizontally as shown in FIG. 23D, or alternatively vertically, and spring 60 may be inserted vertically, or alternatively sideways or laterally. In other aspects spring 60 and cam 70 may be inserted in different orientations provided the cam 70 abuts against the spring 60 which in turn operates to apply a force against the rim 45 of an inserted barrel 41 or barrel assembly 40. Configuring spring 60 with tines 61, 62 to straddle the barrel 41 so that pin 70 abuts both tines 61, 62 accommodates a more uniform securing force to lock the barrel 41 into the receiver 30.

In further aspects, a cam pin 70 is configured to abut directly against the collar or rim 45 of the barrel 41 to secure the barrel 41 within an upper receiver 30. In yet further aspects, where a barrel 41 or barrel assembly 40 includes a groove or grooves (unlike a projection or rim 45), a spring 60 or cam pin 70 is configured to abut within the grooves of the barrel, such that pressure applied via the spring 60 or cam pin 70 locks the barrel into the receiver 30.

In a further aspect, and with reference again to FIGS. 5-7, and FIG. 25, the invention includes a method 100 of securing a barrel 40 to an upper receiver 30 of a firearm 20. In one aspect the method includes the step 110 of inserting a barrel 40 into the barrel end 31 of the upper receiver, the upper receiver having an elongated body defining a bore passing from the stock end 33 through to the barrel end 31, the bore 31' defining a central axis B, and the step 120 of activating the cam 70, which cam 70 is oriented transverse the central axis. Activation of the cam 70 locks the barrel 40 into the upper receiver. In further aspects, a method of securing the barrel 40 includes insertion of a hand guard 50 over the barrel 40 and into the barrel end 31 of the receiver 30, and thereafter inserting the spring 60 in the direction of arrow A shown in FIG. 7 into the spring cavity 32 of receiver 30 such that spring 60 abuts both cam 70 and collar 56. A further step includes rotating the cam to apply force to the spring 60 which applies force to the collar 56 to secure against the rim 45 and lock the barrel 40 within the receiver 30. In further aspects, the barrel 41 and/or barrel assembly 40 may be quickly removed by rotating the cam 70 such that cam 70 no longer applies a force to the barrel 40, and then removing the barrel and replacing it with the same barrel or a different barrel 41'. In aspects, when rotating the cam 70 such that it no longer applies a force includes rotating the cam 70 so that it does not press against the spring 60, thus allowing removal of the spring 60 from the receiver 30, after which the hand guard 50 may be removed, and then removal and replacement of the barrel 40. Additional method aspects or variations thereof may be appreciated based on the above description of the firearm 20, components and systems herein.

In further aspects the invention includes a system for quick connection of a barrel 41 and/or barrel assembly 40 to a firearm 20, including an upper receiver 30 having a barrel end 31 and a stock end 33 and a bore 31' running therethrough. The system includes a barrel 41 inserted into the barrel end 31 and a hand guard 50 passed over the barrel 41 and also inserted into the barrel end 31. A cam or pin 70 is inserted into a pin hole 36 of the receiver 30. A spring is inserted into a spring cavity 32 of the receiver adjacent the cam 70 and a collar 56 of the hand guard 50. The collar 56 abuts a rim 45 of the barrel 40. Rotation of the pin 70 causes pressure on the spring 60 which in turn presses against the collar 56 which presses against the rim 45 to lock the barrel 41 into the receiver 20.

It should be understood, of course, that the foregoing relates to exemplary embodiments of the invention and that modifications may be made without departing from the spirit and scope of the invention as set forth in the following claims.

I claim:

1. A firearm component, comprising:

an upper receiver having a barrel end, a stock end opposite the barrel end, and a spring cavity, the barrel end configured to receive a barrel;

a hand guard having an output end and a receiver end, the receiver end configured to mate with the barrel end of the upper receiver; and a spring configured to fit into the spring cavity to abut the hand guard at the receiver end;

whereby the spring is configured to press against the hand guard which abuts a barrel that may be inserted into the barrel end.

2. The firearm component of claim 1 further comprising a barrel inserted into the barrel end of the upper receiver, the hand guard abutting against the barrel, the spring configured to abut against the hand guard, and further comprising a pin inserted into the upper receiver and abutting the spring whereby rotation of the pin causes the spring to apply force to the hand guard to lock the barrel within the upper receiver.

3. A firearm, comprising:

an upper receiver having a barrel end, a stock end opposite the barrel end, and a spring cavity;

a barrel inserted into the barrel end;

a hand guard having an output end and a receiver end and configured to pass along the barrel, the receiver end configured to mate with the barrel end; and a spring configured to fit into the spring cavity to abut the hand guard at the receiver end to secure the barrel to the upper receiver.

4. The firearm of claim 3 where the barrel includes a rim, and wherein a terminal end of the hand guard abuts the rim.

5. The firearm of claim 3 where the spring cavity is accessed at a top of the upper receiver and is configured to allow the spring to be inserted downward.

6. The firearm of claim 3 where the spring abuts a collar of the hand guard.

7. The firearm of claim 3 where the upper receiver further includes a pin port, a pin positioned in the pin port such that the spring abuts the pin.

8. The firearm of claim 7 where the pin has an elongated pin body having a non-circular cross section, the pin extending through the upper receiver.

9. The firearm of claim 7 where the pin includes a partial cylindrical surface having a flattened portion.

10. The firearm of claim 9 where a non-flattened portion of the pin abuts the spring.

11. The firearm of claim 7 where rotation of the pin forces the spring against a collar of the hand guard which forces the collar against a feature of the barrel, thereby locking the barrel within the upper receiver.

12. The firearm of claim 3 where the spring is made of spring steel and includes a first tine and a second tine which straddle the barrel.

13. The firearm of claim 3 where the spring has a first tine, a second tine, and defines a gas tube gap, the barrel having a gas tube which passes through the gas tube gap.

14. A method of assembling the firearm of claim 3, comprising:

inserting the barrel into the barrel end of the upper receiver, the barrel having a rim and a bore defining a central axis therethrough; and rotating, within the upper receiver, a pin having an elongated pin body, the pin body having a non-circular cross-section, the elongated pin body oriented transverse the central axis such that rotation of the pin locks the rim of the barrel into the upper receiver.

15. The method of claim 14 further comprising positioning the hand guard over the barrel and into the barrel end of the upper receiver, where rotation of the pin applies force to the hand guard which in turn applies force to the rim to lock the barrel into the upper receiver.

16. The method of claim 14 further comprising inserting the spring into the upper receiver, where rotation of the pin applies force to the spring which in turn applies force to the rim to lock the barrel into the upper receiver.

17. A system for quick connection of a barrel to a firearm, the system comprising:

a receiver having a body defining a spring port and configured to receive the barrel;

a spring positioned within the spring port and configured to straddle the barrel; and a cam abutting the spring and configured to turn to secure the barrel within the receiver.

18. The system of claim 17 further comprising a barrel positioned within the receiver, a hand guard positioned over the barrel and abutting a rim of the barrel within the receiver, the spring configured to abut the hand guard such that rotation of the cam causes the spring to force against the hand guard which in turn presses against the rim to secure the barrel within the firearm.

19. A firearm component, comprising:

an upper receiver having an elongated unitary body defining a bore passing from a stock end through to a barrel end, the bore defining a central axis, the barrel end configured to receive a barrel of a firearm; and a cam positioned in a wall of the unitary body of the upper receiver and oriented transverse the central axis;

whereby activation of the cam locks into the upper receiver a barrel which may be inserted therein.

20. The firearm component of claim 19 where the cam comprises a pin having an elongated pin body having a non-circular cross-sectioned portion, the pin oriented perpendicular to the central axis, where rotation of the pin locks into the upper receiver the barrel which may be inserted therein.

21. The firearm component of claim 19 where the cam comprises a pin having an elongated pin body with a non-circular cross-section, the firearm component further including a spring which inserts into a spring cavity of the elongated body, where rotation of the pin causes the spring to exert a force to lock a rim of a barrel within the upper receiver.

22. The firearm component of claim 21 further comprising a barrel having a rim inserted into the barrel end, and where the spring includes a pair of tines which straddle a hub of the barrel.

23. The firearm component of claim 19 where the cam comprises a pin having an elongated pin body and where a spring is inserted downwardly into the upper receiver, the elongated pin body positioned below the central axis and passing through the upper receiver, and where rotation of the pin causes a force to be applied to the spring.

* * * * *